United States Patent [19]

Frick

[11] 4,197,953

[45] Apr. 15, 1980

[54] DOUBLE SLEWING CRANE CONSTRUCTION

[75] Inventor: Egon Frick, Lübeck, Fed. Rep. of Germany

[73] Assignee: Orenstein & Koppel AG, Fed. Rep. of Germany

[21] Appl. No.: 703,596

[22] Filed: Jul. 8, 1976

Related U.S. Application Data

[63] Continuation of Ser. No. 513,118, Oct. 8, 1974, abandoned.

[51] Int. Cl.[2] ..... B66C 23/00; B66C 23/52; B66C 5/02

[52] U.S. Cl. ..... 212/47; 414/140; 212/3 R; 212/58 R

[58] Field of Search ..... 212/3, 28, 47–48, 212/66–69, 29, 58 R; 214/12, 15 R; 9/34, 39–40; 114/5 R, 44; 414/137, 140

[56] References Cited

U.S. PATENT DOCUMENTS

| | | | |
|---|---|---|---|
| 1,207,423 | 12/1916 | Lundin | 212/47 |
| 3,061,111 | 10/1962 | Riemenschneider | 212/21 |
| 3,684,104 | 8/1972 | Oda et al. | 212/47 |
| 3,814,264 | 6/1974 | Frick | 212/3 |

FOREIGN PATENT DOCUMENTS

| | | | |
|---|---|---|---|
| 877419 | 5/1953 | Fed. Rep. of Germany | 212/3 |
| 1965650 | 7/1971 | Fed. Rep. of Germany | 212/47 |
| 1965651 | 7/1971 | Fed. Rep. of Germany | 212/47 |
| 1965659 | 7/1971 | Fed. Rep. of Germany | 212/47 |
| 2064468 | 12/1971 | Fed. Rep. of Germany | 212/47 |
| 103245 | 1/1964 | Norway | 212/3 |
| 1233419 | 5/1971 | United Kingdom | 212/47 |

OTHER PUBLICATIONS

Engineering News, Jun. 7, 1915, vol. 73, No. 24, pp. 1164–1165.

*Primary Examiner*—Stephen G. Kunin
*Assistant Examiner*—R. B. Johnson
*Attorney, Agent, or Firm*—McGlew and Tuttle

[57] ABSTRACT

A double slewing crane comprises a vertical support or column which is adapted to be fixed in position, for example on a ship between two cargo hatches. A first crane arm or cantilever arm is pivotally mounted on the support for pivotal movement about a vertical axis and a second crane arm or cantilever arm is pivotally mounted on the support for pivotal movement about the same vertical axis. Each crane arm carries a jib which is pivotally mounted at its inner end about a horizontal axis and one of the jibs may be made shorter than the other. The pivotal mounting includes a ring gear which, for example, may be fixed with respect to the support, and each cantilever arm portion carries a drive motor with a drive pinion which engages the ring gear to effect the individual rotative motion of the associated cantilever arm. Drive motors of the two cantilever arms may be synchronized so that the arms rotate together about the fixed ring gear. Each cantilever arm carries a crane tower, turret, or mast with the jib and the towers may be spaced apart from each other by positioning their associated supporting arms at a respective angle from an extension of the common vertical axis. Alternately a first crane and tower, turret, or mast may be mounted for pivotal movement about an axis directly above the supporting member and the second crane may be carried on a cantilever arm at the outer end thereof so that it pivots about the common vertical axis at a location spaced radially from the first vertical axis.

3 Claims, 9 Drawing Figures

DOUBLE SLEWING CRANE CONSTRUCTION

CROSS REFERENCE TO RELATED APPLICATION

This applicaton is a continuation of application Ser. No. 513,118, filed Oct. 8, 1974, now abandoned.

BACKGROUND OF THE INVENTION

1. FIELD OF THE INVENTION

This invention relates in general to the construction of cranes and in particular to a new and useful double slewing crane which includes a vertical support member or column and individual cranes which are mounted on respective cantilever arm supports for pivotal movement about a common vertical axis and each of which carries a separate jib and a drive motor which engages a common ring gear for effecting the pivotal movement thereof and wherein the respective arms are mounted for pivotal rotation on roller bearings.

2. DESCRIPTION OF THE PRIOR ART

REFERENCE TO A PREVIOUS U.S. PATENT

The present invention is an improvement over the invention disclosed and claimed in U.S. Pat. No. 3,814,264 dated June 4, 1974.

The invention described in U.S. Pat. No. 3,814,264 is directed to a double slewing crane which is as simple as possible in design and is adapted to permit any desired operation in practice with a single crane or with the conjoint use of both cranes and in which particulary the mounting of the cranes is simplified so as to insure a horizontal and vertical stability, the whole construction thus being low in cost. The construction insures the reduction of the number of toothed gears or ring gears for the pivot drive and the number of bearings for the rotary motion which is necessary. The construction has the advantage that for all of the desired kinds of operation only a single ring gear is necessary for the pivot drive and only two pivot drives are provided which do not require any coupling or particular locking mechanisms. In order to rotate the cranes conjointly it is sufficient to couple the two drives electrically or hydraulically and this can be done without any difficulty. In the patented construction the crane support which is firmly connected to the ship may carry a ring gear with which the drive pinions of the two cranes are engaged. The drive motors of the two pivot drives may be connected in synchronism so that they operate in conjoint operation with the two slewing cranes being rotated together in exact uniformity. Further the pivotal cantilever arm of the double slewing crane may be connected to the ship borne crane support through a ball bearing slewing or pivoting gear. The first crane may also be connected to the ship borne crane support through a ball bearing slewing gear. In addition the two ball bearing slewing gears, that is the inner ring and the outer ring, may be assembled with a middle ring to a single constructional unit and the four race middle ring may be firmly connected to the ship borne crane support.

SUMMARY OF THE INVENTION

The present invention is an improvement over known constructions and provides a double slewing crane which may be used for any kind of work in individual or conjoint operation. In a first embodiment the jib of the second crane is made shorter than the jib of the first crane and the tower, turret, or mast of the second crane is secured to its associated support arm or cantilever arm so that, in a position for conjoint operation, the tower of the second crane is offset in the direction of the extension of the jibs in advance of the tower of the first crane. Such a construction has the advantage that, in individual operation, the two cranes may pivot through a larger angle relative to each other so that the angle of mutual blocking of the two cranes becomes smaller.

In accordance with another development of the invention, the horizontal axis of the second crane may be located higher than the horizontal axis of the first crane. This has the advantage that, in a position for conjoint operation, the differences in height of the jib head pulleys in any luffing position of the two jibs are smaller than with the horizontal axes of the two cranes at the same level.

In accordance with a still further development of the invention, the angle formed by the jib of the second crane with a straight line connecting the center of the second crane to the common vertical pivot axis, as seen in a top plan view, may be approximately from 105° to 135°. This angle depends on the length of the jibs, the mutual spacing between the tower and the jib and the width of the jib in a top view.

In accordance with a further feature of the invention, the first and second cranes and crane towers with their associated jibs are carried on cantilever arms which have pivots about a common vertical axis and the arms are of a length such that the axes of the crane towers are spaced angularly from each other. Each of the cranes is secured to a cantilever arm or swing body which is pivotal about a common vertical axis. At least one of the swing bodies is connected to the ship borne crane support through a ball bearing slewing gear. This design has the advantage that, in individual operations, the cranes can work through a larger angle, that is the angle of mutual blocking of the individual cranes is reduced. Another advantage is that, in the rest position, that is, in the secured position during navigation at sea, the sight of the steersman over the ship's center is not obstructed by the cranes because in this direction no crane towers are in line.

In accordance with another deveopment of the invention, the horizontal axes of the two jibs may be provided in the lower part of the towers, below the ball bearing slewing gear. This results in a smaller overall height of the crane and the center of gravity of the whole installation is thereby lowered. It is useful to provide the horizontal axes of both cranes at the same level. For individual operation in accordance with another embodiment, the horizontal axis of at least one of the jibs may extend at an angle to the plane passing through the common pivot axis and the vertical center line of the tower. Advantageously both crane jibs may be designed in this manner. A particularly large working range is thereby obtained in individual operation.

In order to reduce the hindrance radius of the cranes relative to the deck cargo, a further embodiment of the invention provides that the lower ends of the towers are set back in the direction of the jibs so that the upper front edge of the set off surface is located in advance of the respective lower front edge. To further simplify the construction of the crane, a ladder may be provided within the upper swing body, having its foot end projecting into the interior of the crane support. Also the lower end of the ladder may be connected to the engaging member of a slip ring body for the current supply to the drive motors.

Finally, as in the main patent in a particularly simple embodiment the two swing bodies of the cranes may be connected to the ship borne crane support through a four-race ball bearing slewing gear of which one ring is firmly connected to the crane support.

Accordingly it is an object of the invention to provide an improved double slewing crane wherein first and second cranes are carried on first and second crane support arms which are rotatably mounted on a support column for rotation about a vertical axis and wherein each support arm carries its own drive pinion which engages a ring gear carried on the support and wherein the cranes may be positioned for conjoint operation or sole operation and in which each of the cranes carries a jib which is pivotal about a horizontal axis.

A further object of the invention is to provide a double slewing crane which is simple in design, rugged in construction and economical to maufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
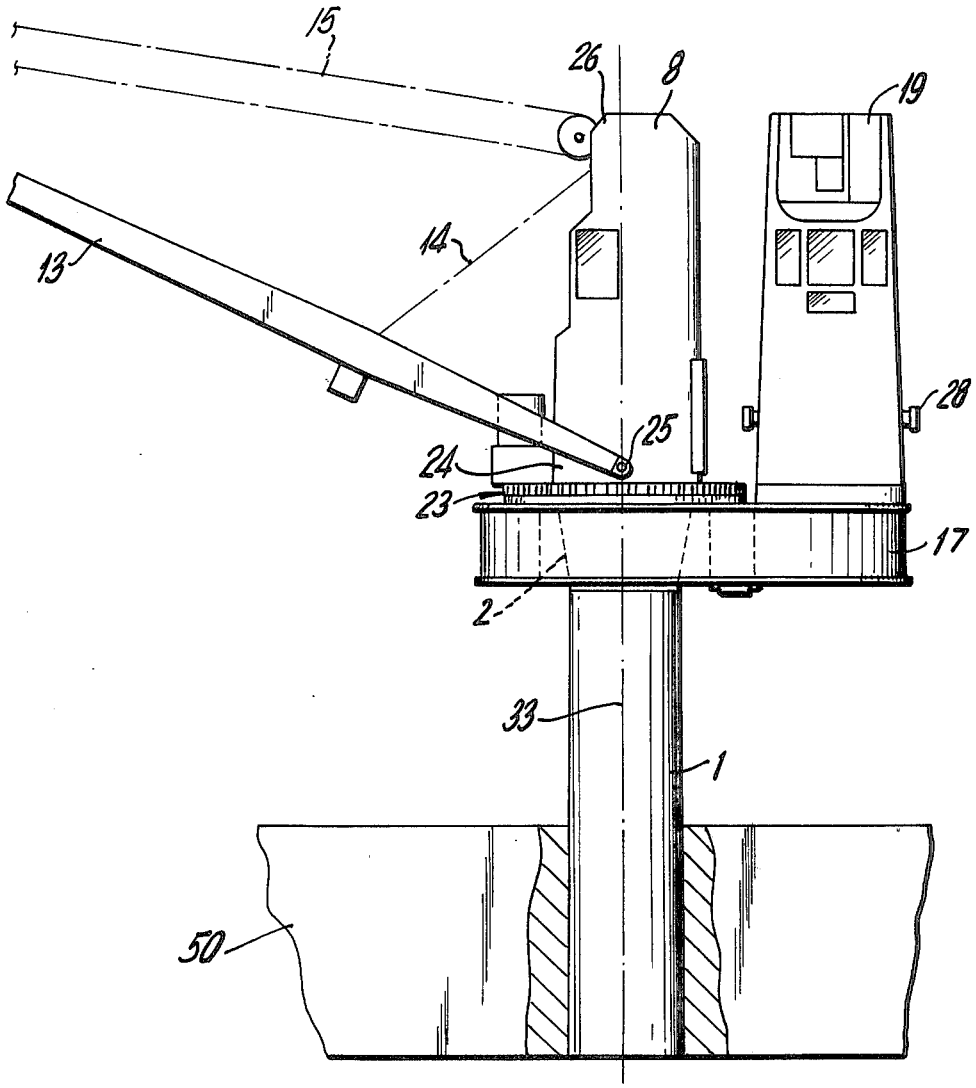
FIG. 1 is a side elevational view of a double slewing crane constructed in accordance with the invention.

Referring to the drawings in particular the invention embodied therein comprises a double slewing crane which includes a vertical column or support 1 which is anchored on a support plate or deck 50 of a ship. The crane support includes an upper conical headpiece 2 covered by a fixed horizontal headplate 3 which is shown only in FIG. 3. A middle ring 4 of a four-race ball or roller bearing slewing gear generally designated or pivoting gear 23 is secured to the plate 3 and projects above the headpiece 2. A toothed rim or annular gear 6 is fixed to the upper side of the stationary middle ring 4. Inner ring 6 of the ball bearing slewing gear 23 is seated at the interior of the middle ring 4 and is firmly secured to a tower 7 of a first crane generally designated 8.

Figure 3:
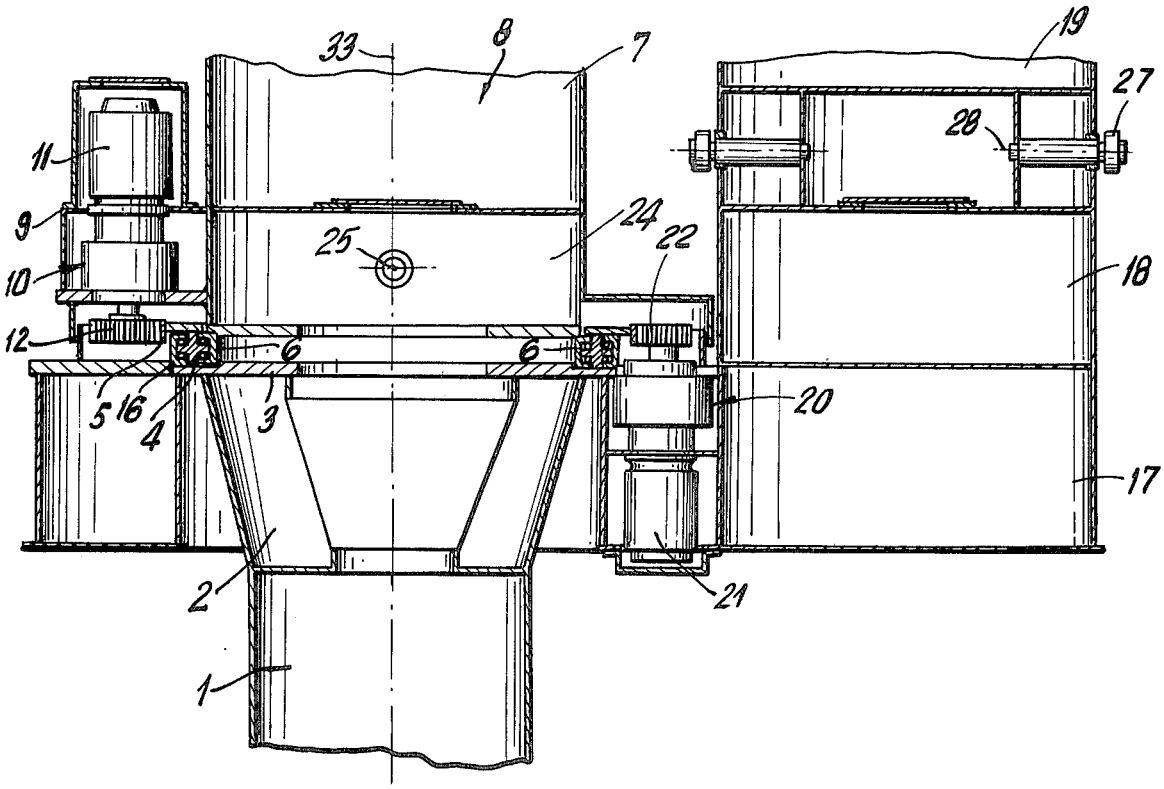
FIG. 3 is a transverse vertical sectional view of the crane shown in FIG. 1.

From FIG. 3, it will be noted that the slewing or pivoting gear 23 includes a cruciform middle ring 4 and a channel cross-section outer rings 6 and 16, each embracing a respective side of the middle or central ring 4. The flanges of the channel shape inner and outer rings 6 and 16 extend substantially to the vertical arm of the cruciform cross-section middle or center ring 4, and the webs of these channel cross-section inner and outer rings 6 and 16 are substantially in contact with the horizontal arm of the cruciform cross-section middle ring 4. Ball or roller bearings are disposed on both sides of the vertical arm of the cruciform cross-section middle ring 4 and above and below the horizontal arm thereof. Thus, the slewing or pivoting gear generally designated 23 constitutes a tilt-proof four-race ball bearing slewing or pivoting gear. It should be noted that the middle ring 4 is stationary or non-rotatable.

The tower, turret, or mast 7 is provided with a bracket structure 9 which supports a drive motor 11 of a pivot drive generally designated 10. The drive motor 11 drives a drive pinion 12 which is in meshing engagement with the annular gear 5 so that rotation of the first crane may be effected about the axis 33. The first crane 8 includes a jib 13 which, as shown in FIG. 1, is pivoted about a horizontal pivot 25 at the lower or foot end 24 of the tower 7. Luffing 14 and hoisting cables 15 are attached to winches 26 and connected to operate the jib 13 to raise and lower it and to move a lifting hook associated therewith.

An outer ring 16 of the ball bearing slewing gear 23 is affixed to a cantilever arm or pivot base 17 which is designed as a box beam. A second crane pivot drive generally designated 20 is mounted on the arm 17 and includes a drive motor 21 rotating a pinion 22 which is engaged with the annular gear 5. A second crane generally designated 19 includes a tower, turret, or mast 18 mounted on the arm 17 and which is also rotated about central vertical axis 33 by rotatable pinion 22 meshing with the stationary ring gear 5.

Figure 2:
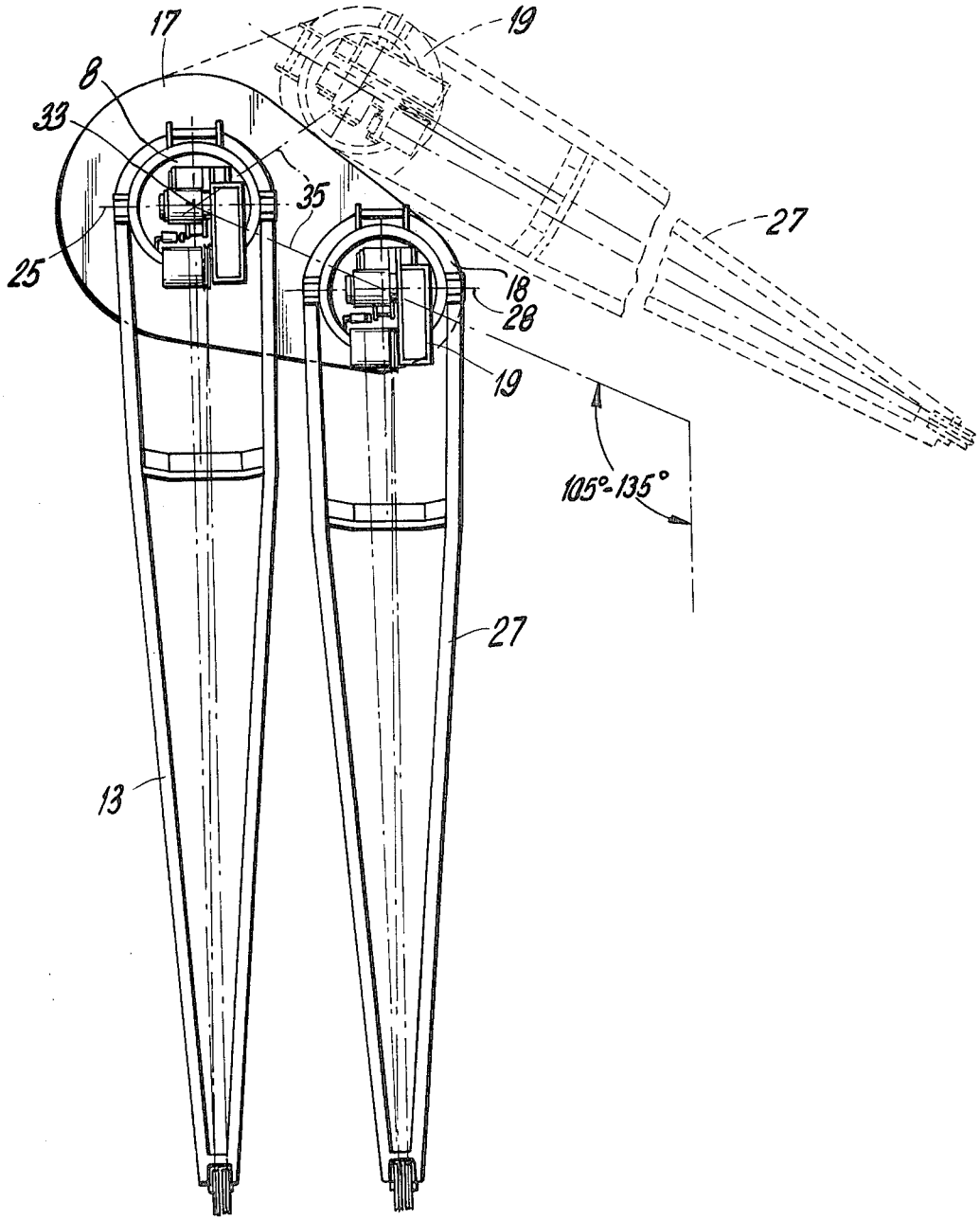
FIG. 2 is a top plan view of the crane shown in FIG. 1.

As best seen in FIG. 2 the second crane 19 is offset in respect to the first crane 8 on its mounting on the arm 17 in the direction of the jibs 13 and 27. With the mounting in this fashion in accordance with the invention, and by using a jib 27 of the second crane 19 which is shorter than the jib 13 of the first crane, it is possible to provide for the conjoint operation position shown in FIG. 2 and also the two cranes may be moved relatively to each other through a larger angle than would normally be possible when they are to be operated singly. The reason for this is that the angle of mutual blocking of the two cranes becomes smaller. The second crane 19 is firmly and non-rotatably connected to the cantilever arm or pivot base 17 in a manner such that its jib 27 forms an angle with a straight line 35 connecting the center of the tower 18 and the vertical pivotal axis 33 which is approximately from 105° to 135°. In the dotted line position shown in FIG. 2 the second crane 19 is in an intermediate position in which it may be placed when used in an individual operation the first crane not having changed its position, relative to the arms 17. The horizontal axis 28 is placed at a higher level on tower 18 than is axis 25 of the jib 13. Jib 27, being shorter than jib 13, this positioning causes the far ends of the jibs 13 and 27 to be positionable at the same level for conjoint operation.

In the embodiments of the invention shown in FIGS. 4 to 8 similar parts are similarly designated but with a prime. The double slewing crane includes a crane support 1' which provides a mounting for a first crane generally designated 8' and a second crane generally designated 19'. An annular gear 5' is mounted on the upper end of the column 1 through a middle ring 4' of a four-race slewing gear generally designated 23'. An inner ring 6′ of the slewing gear 23′ is seated on the inside of the middle ring 4′ and is fixed to a swing body or arm 29. The arm 29 comprises a box beam 30 which has an annular shape in the zone directlly adjacent the slewing gear 23′. The box beam 30 comprises a cantilever portion 31 which extends in the direction of the first crane 8′ and which projects over and beyond the circular ring carrier 32 affixed to the cantilever arm 17′ of the second crane 19′. The tower 7′ of the first crane 8′ is rigidly connected to the arm 29 ring carrier 31. The lower end of the tower 7′ is set back in the direction of its associated jib 13′ so that the upper front edge 48 of the setback surface 49 is located in advance of a lower front edge 50*a*.

A pivot drive 10′ for the first crane 8′ includes a drive motor 11′ with a drive pinion 12′ engaged with the fixed annular gear 5′.

The cantilever arm 17′ includes the circular ring carrier 32 which surrounds the crane support 1′ and is secured to the outer ring 16′ of the ball bearing slewing gear 23′. A tower 18′ of the second crane 19′ extends upwardly from the arm 17′.

A second crane pivot drive generally designated 20′ is carried on the arm 17′ and it comprises a drive motor 21′ and a drive pinion 22′ which is engaged with the fixed annular gear 5′.

Figure 6:
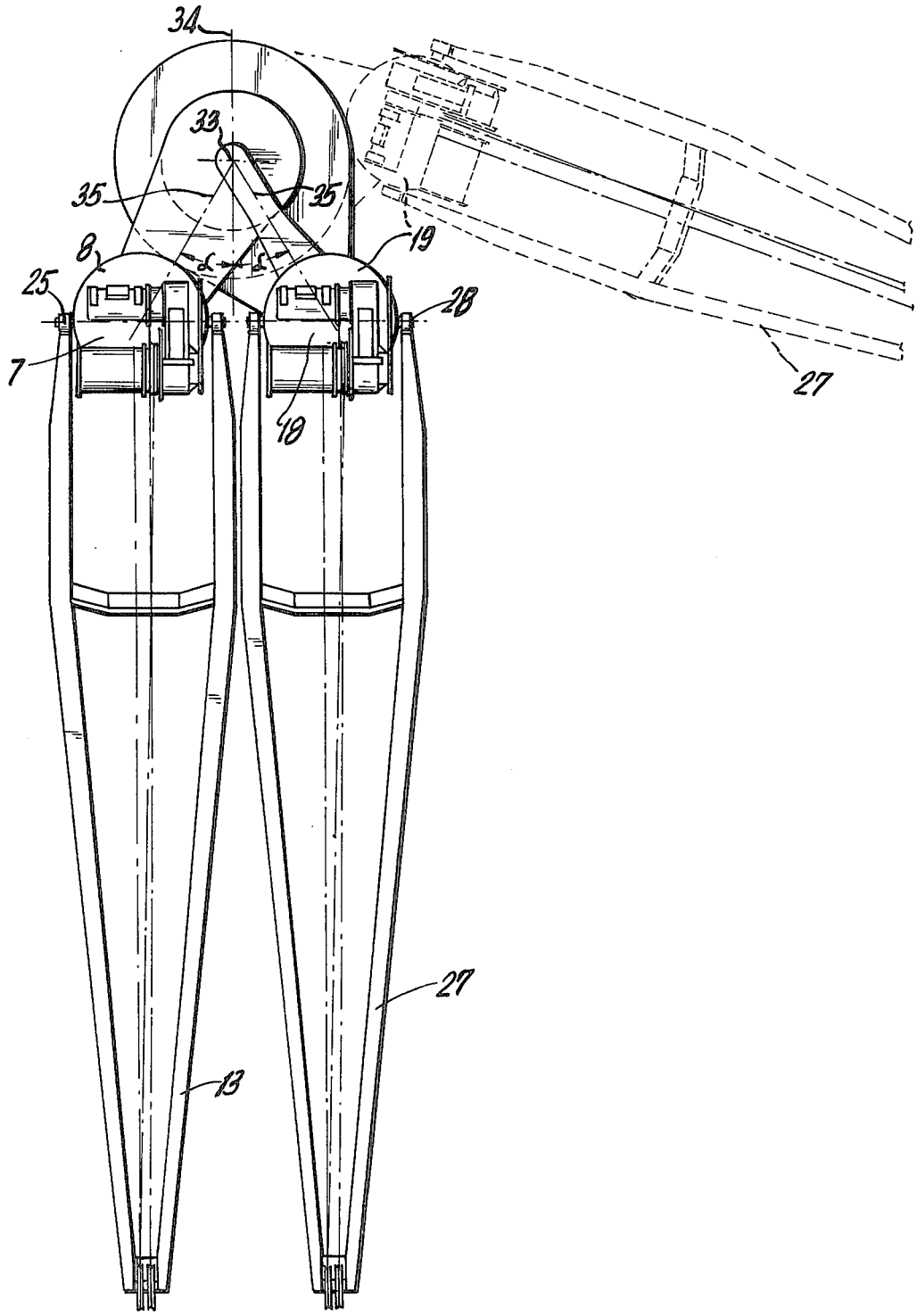
FIG. 6 is a plan view of the embodment shown in FIG. 4.

As the two cranes 8′ and 19′ are rotated, the displacement parts, that is the supporting arms 17′ and 31′, rotate therewith. In individual operation, each crane 8′ and 19′ can pivot independently of the other about the common pivot axis 33′. During a conjoint operation, the drive motors 11′ and 21′ of the two pivot drives 10′ and 20′ may be connected together in synchronism so that both cranes rotate about common axis 33 in a uniform manner. The position for conjoint operation is shown in FIG. 6 in solid lines. In this case the jibs 13′ and 27′ of the cranes 8′ and 19′, respectively, are oriented in immediately adjacent positions so that they may conjointly transport a particularly heavy load. The second crane 19 is shown in an independently operable position in dotted lines and at such a location each of the cranes may operate independently of each other.

Figure 4:
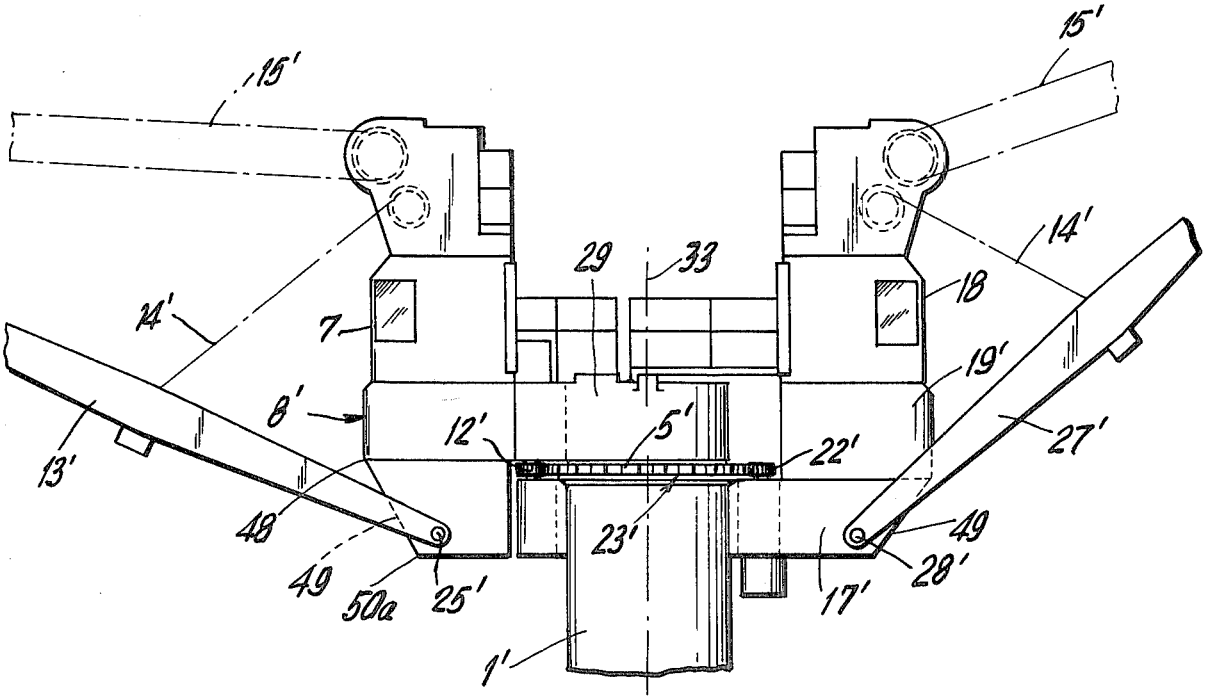
FIG. 4 is a side elevational view similar to FIG. 1 of a further embodiment of the invention.

In the embodiment of FIGS. 4 to 8 cranes 8′ and 19′ are luffing cranes which have towers 7′ and 18′ which are equally spaced from a common vertical pivot axis 33. The associated jibs 13′ and 27′ are mounted at the lower ends of the towers 7′ and 18′, respectively, and they are pivotable about horizontal axes 25′ and 28′ respectively. Both are equipped with luffing 14′ and hoisting cables 15′ as shown in FIG. 4. As shown in the top plan view of FIG. 6, the horizontal axes 25′ and 28′ of the cranes 8′ and 19′ are in position for conjoint operation and extend symmetrically of the main central line 34 with each being at an angle alpha relative to the straight line 35 connecting the vertical pivot axis 33 and the centers of the respective towers 7′ and 18′. This angle alpha at the sides of the jibs 13′ and 27′ which face each other is substantially smaller than 90°.

Figure 7:
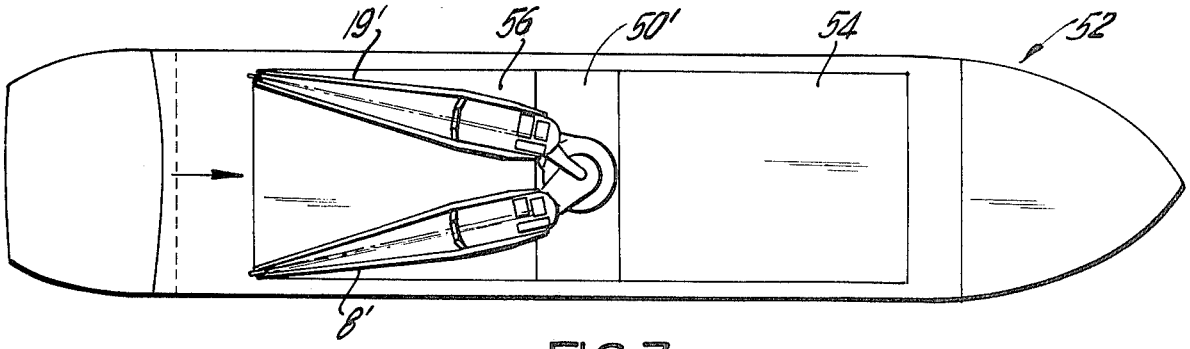
FIG. 7 is a top plan view of the crane shown in FIG. 4 oriented on a ship in respect to the holds thereof with the cranes arranged in a combined operational position.
Figure 8:
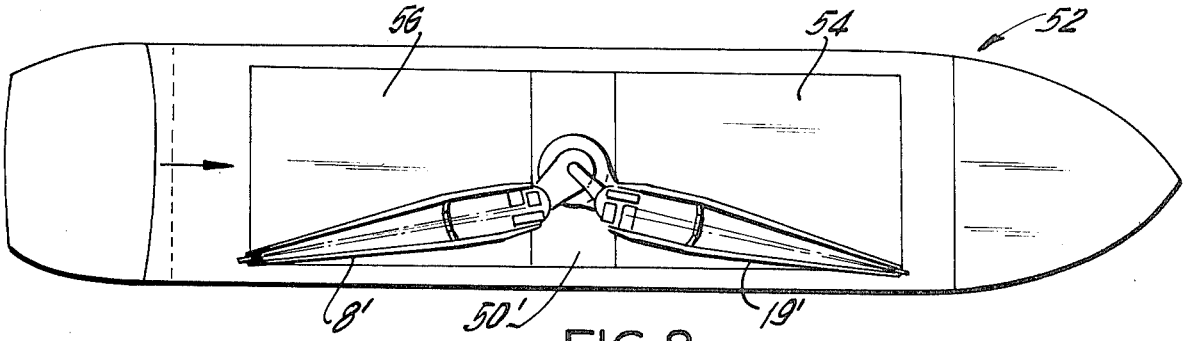
FIG. 8 is a view similar to FIG. 7 showing the cranes arranged to operate in two ship holds.

In FIGS. 7 and 8 the cranes 8′ and 19′ are shown as being mounted on support 1′ which is secured on a central plate 50′ of a ship 52 having cargo holds 54 and 56 on respective sides of the plate 50′. The cranes 8′ and 19′ may be used conjointly on a single hold 56 as shown in FIG. 7, or may be used separately to work the holds 54 and 56 as indicated in FIG. 8.

Figure 5:
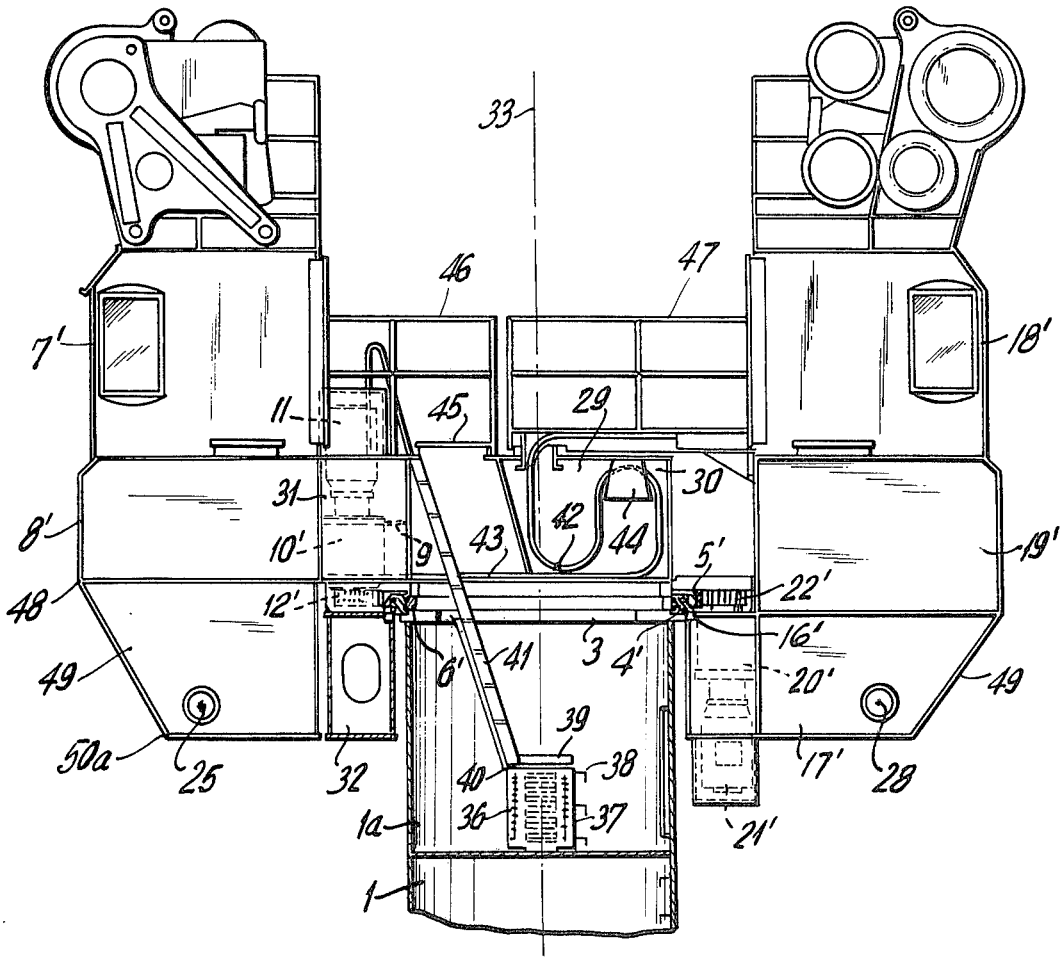
FIG. 5 is a partial sectonal view of the crane shown in FIG. 4.

As best shown in FIG. 5 electrical power is supplied from the ship through a slip ring body 36 located in the crane support 1′. The shrouding or cover 37 of the slip ring body is stronger than would normally be required since it forms a lower portion of a ladder having steps 38 leading to a platform 39 which is located above the body 36. A ladder 41 supporting the platform 39 is secured to the engaging member 40 of the slip ring body 36 and the upper end of the ladder 41 is applied against the arm 29′ of the first crane 8′. Cables 42 for the current supply are fixed to the ladder 41 and run therealong from the slip ring body 36 up to a manhole 43 which is provided in the lower part of the arm 29′. From the manhole 43 cables 42 run to the electrical devices of the respective cranes. In order to protect the cable 42 of the second crane 19 against excessive stresses it is passed over a cable saddle 44 which is mounted in the arm 29 of the first crane 8′. The arm 29 is provided with a water tight closable manhole 45 about the ladder 41. The crane operators may pass through the manhole 45 to the cranes 8′ and 19′ over footbridges 46 and 47.

Figure 9:
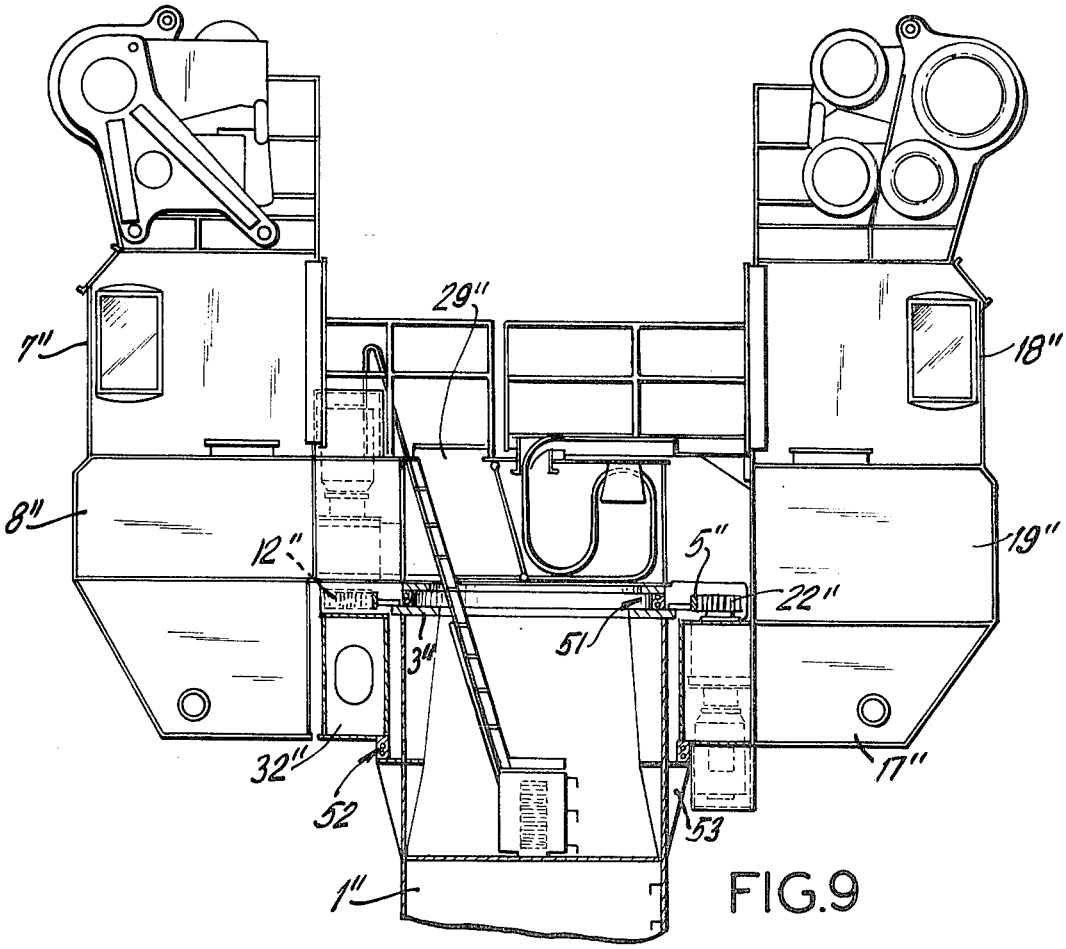
FIG. 9 is a transverse vertical sectional view of another embodiment of the invention.

In the embodiment shown in FIG. 9, the parts which are similar to those shown in the embodiments of FIGS. 1 to 8 are shown with double primes. In this construction, instead of a four race ball bearing slewing gear 23 or 23′, the construction includes a two race ball bearing slewing gear generally designated 51 and a second two race slewing gear generally designated 52 which is arranged below the first. A first ring of ball bearing slewing gear 51 carrying the pivotal arm 29″ of the first crane 8″ is secured to a connection plate 3″ of the crane support 1″. Also secured to the connection plate 3″ is an annular gear 5″ which engages with drive pinions 12″ and 22″ of the first crane 8″ and the second crane 19″, respectively. The ball bearing slewing gear 52 of the second crane 19″ is mounted below the cantilever arm 17″ on an annular bracket 53 provided on the crane support 1″ and it carries the portion of cantilever arm 17″ which is designed as a circular ring carrier 32″.

While specific embodiments of the invention have been shown and described in detail to illustrate the application of the principles of the invention, it will be understood that the invention may be embodied otherwise without departing from such principles.

What is claimed is:

1. A double slewing crane comprising, in combination, an upright support column having a substantially vertical central axis; a ring gear fixed to the upper end of said column concentric with said axis; anti-tilt anti-friction bearing means including at least one bearing race affixed to said column concentric with said axis, first and second rotatable bearing races concentric with said axis, and anti-friction elements disposed between said fixed and rotatable bearing races; a first crane, including a first crane control and operating tower affixed to said first rotatable bearing race; a second crane, including a second crane control and operating tower affixed to said second rotatable bearing race; a first jib mounted on said first tower for pivoting about a first horizontal axis on said first tower; a second jib mounted on said second tower for pivoting about a second horizontal axis on said second tower; first drive means on said first tower including a first pinion meshing with said ring gear; and a second drive means on said second tower including a second pinion meshing with said ring gear; whereby said first and second towers are rotatable about said vertical central axis of said upright support column, as a common axis of rotation; at least one of said towers being offset radially from said common axis; when the two jibs are parallel to each other the horizontal angle between the jib mounted on said offset tower and a horizontal line connecting the center of said offset tower and said common axis being substantially from 105° to 135°, the other one of said crane control and operating towers having a vertical center line coinciding with said common axis, the jib of said offset tower having a length less than the jib of said other tower by an amount such that, when the two jibs are rotated into substantial parallel relation with each other for conjoing handling of a heavy load, the outer ends of the two jibs lie in a common plane that is substantially perpendicular to the longitudinal axis of said jibs; the horizontal pivot axis of the jibs of said offset tower being spaced vertically upwardly from the horizontal pivot axis of the jib of said other tower.

2. A double slewing crane, as claimed in claim 1, including a circular head plate affixed to the upper end of said upright support column; said anti-tilt anti-friction bearing means including at least one bearing race affixed to said headplate concentric with said axis.

3. A double slewing crane, as claimed in claim 2, including a cruciform bearing race having mutually perpendicular and intersecting horizontal and vertical arms, said vertical arm being affixed to said headplate and said ring gear being affixed to said vertical arm; said first and second rotatable bearing races comprising facing channel cross-section bearing races mutually embracing said horizontal arm of said cruciform cross-section bearing races; said anti-friction elements being disposed in said channel cross-section bearing races on opposite sides of the vertical arm and above and below said horizontal arm of said cruciform cross-section fixed bearing race.

* * * * *